US010266330B2

(12) United States Patent
Tanaka

(10) Patent No.: US 10,266,330 B2
(45) Date of Patent: Apr. 23, 2019

(54) COMPRESSION BAG AND DEFLATION VALVE FOR USE THEREWITH

(71) Applicant: MISUMARU SANGYO CO., LTD., Kagawa (JP)

(72) Inventor: Kazuya Tanaka, Nara (JP)

(73) Assignee: MISUMARU SANGYO CO., LTD., Kagawa (JP)

( * ) Notice: Subject to any disclaimer, the term of this patent is extended or adjusted under 35 U.S.C. 154(b) by 0 days.

(21) Appl. No.: 15/432,481

(22) Filed: Feb. 14, 2017

(65) Prior Publication Data

US 2018/0229912 A1 Aug. 16, 2018

(51) Int. Cl.

| | |
|---|---|
| ***B65D 51/16*** | (2006.01) |
| ***B65D 81/20*** | (2006.01) |
| *B65D 90/34* | (2006.01) |
| *B65D 85/07* | (2017.01) |
| *A45C 13/02* | (2006.01) |

(52) U.S. Cl.

CPC ..... *B65D 81/2038* (2013.01); *B65D 81/2023* (2013.01); *A45C 2013/028* (2013.01); *B65D 85/07* (2018.01)

(58) Field of Classification Search

CPC .. B65D 81/2038; B65D 85/07; B65D 77/225; B65D 81/2023; A45C 2013/028

USPC .. 220/745, 231, 203.04, 203.05, 360, 366.1, 220/367.1; 215/262, 307

See application file for complete search history.

(56) References Cited

U.S. PATENT DOCUMENTS 5,819,964 A * 10/1998 Grimard ..... B65D 51/002 215/249
5,992,660 A * 11/1999 Miura ..... B65D 51/002 215/247

(Continued)

FOREIGN PATENT DOCUMENTS

| | | |
|---|---|---|
| JP | H0544837 U | 6/1993 |
| JP | 2007204097 A | 8/2007 |
| JP | 4859838 B2 | 1/2012 |

OTHER PUBLICATIONS

English Abstract of JP2007204097, Publication Date: Aug. 16, 2007.

(Continued)

*Primary Examiner* — J. Gregory Pickett
*Assistant Examiner* — Niki M Eloshway
(74) *Attorney, Agent, or Firm* — Millen, White, Zelano & Branigan, P.C.; William Nixon

(57) ABSTRACT

A deflation valve for use with a compression bag includes a base member and a lid member attached to the base member. The base member includes a deflation port and an inner cylindrical portion. The lid member includes a valve member and an outer cylindrical portion surrounding the valve member. The outer cylindrical portion includes an air passage portion and is arranged outwardly of the inner cylindrical portion. Suction of the deflation port causes an upward movement of the lid member to open the deflation port, imparting a negative pressure to the compression bag via the air passage portion and the deflation port. Stopping of the suction causes a downward movement of the lid member due to the negative pressure to close the deflation port with the valve member. The air passage portion serves as a finger hooking portion when opening the deflation port.

7 Claims, 7 Drawing Sheets

(56) References Cited

U.S. PATENT DOCUMENTS

| | | | | |
|---|---|---|---|---|
| 7,475,864 | B2 | 1/2009 | Tanaka | |
| 9,731,877 | B2 * | 8/2017 | Aneas | B65D 51/00 |
| 2002/0066732 | A1 * | 6/2002 | Ogino | A47J 45/063 220/203.04 |
| 2007/0017926 | A1 * | 1/2007 | Lin | B65D 75/5877 220/745 |
| 2007/0068841 | A1 | 3/2007 | Tanaka | |
| 2008/0253698 | A1 | 10/2008 | Tanaka | |
| 2009/0001042 | A1 * | 1/2009 | Sever | B65D 41/28 215/248 |
| 2011/0068106 | A1 * | 3/2011 | Zukor | B01L 3/50825 220/367.1 |
| 2016/0137474 | A1 * | 5/2016 | Marantis | A61J 1/14 141/331 |

OTHER PUBLICATIONS

Mechanical Translation of JPH0544837, Publication Date: Jun. 15, 1993.

* cited by examiner

COMPRESSION BAG AND DEFLATION VALVE FOR USE THEREWITH

BACKGROUND OF THE INVENTION

Field of the Invention

The present invention relates to a compression bag and a deflation valve for use with the compression bag.

Description of the Related Art

A compression bag is widely used in which an item, such as, e.g., bedding (futon) and clothing, accommodated in a bag can be compressed by deflating the bag to thereby reduce the bulk of the item.

This compression bag is equipped with a deflation valve capable of performing the aforementioned compression by applying a negative pressure to the inner side of the deflation bag by sucking with a vacuum cleaner at home (see Japanese Unexamined Utility Model Application Publication No. Hei 5-44837 (hereinafter referred to as Patent Document 1), Japanese Patent No. 4859838 (hereinafter referred to as Patent Document 2), and Japanese Unexamined Patent Application Publication No. 2007-204097 (hereinafter referred to as Patent Document 3)).

Hereinafter, the details will be described.

The deflation valve for use with a storage bag for storing, e.g., bedding, disclosed in Patent Document 1 is equipped with a base member having an appropriate fixing means at an appropriate position of the outer peripheral surface and constituting a deflation port by being attached to a deflation port provided in the storage bag for bedding, etc., a lid member to be screwed to the exposed portion of the base member exposed to the outer side of the storage bag, and a separately formed valve body. The base member is provided in its inner side with a partition wall partitioning the inner side and the outer side of the storage bag, and the partition wall is provided with a communication opening communicating the inner side and the outer side of the storage bag. The upper surface of the lid member includes a corresponding portion which comes into contact with a suction port of a vacuum cleaner and an appropriate number of holes that lead to the inner side of the lid member in a region to be surrounded by a suction port periphery of the vacuum cleaner on the corresponding portion. The valve body is arranged in a space surrounded by the partition wall of the base member and the lid member. When the lid member is loosened, the valve body is drawn to the communication opening in the aforementioned space by the negative pressure in the storage bag so that the valve body can close the communication opening and is drawn to the communication opening of the lid member when sucked by a vacuum cleaner so that the valve can be separated from the communication opening. When the lid member is screwed so as to be tightened to the base member, the valve body is pressed against the communication opening by the lid member to maintain the sealed state of the communication opening (see claim 1).

In the valve disclosed in Patent Document 1, since the valve body is biased by a biasing means, even when sucked with an electric vacuum cleaner, there was a problem that a time difference occurred in the operation of the valve body and therefore quick deflation cannot be performed. Further, there also was a problem that a biasing means and a packing are required, so the number of constituent members was large.

Patent Document 2 was proposed to solve the above-described problems of Patent Document 1.

That is, the deflation valve for use with a compression bag shown in Patent Document 2 is provided with a base member (2) having a screw portion (24*a*) and constituting a deflation port of a compression bag (B) when attached to a through-hole provided in the compression bag (B), a lid member (3) attached to the upper side of the base member (2) by being screwed into the screw portion (24*a*), and a valve body (4) formed separately from the base member (2) and the lid member (3).

The above-described base member (2) is provided with a partition wall (21) for partitioning the inner side and the outer side of the compression bag (B), and the partitioning wall (21) is provided with a deflation port (22) communicating the inner side and the outer side of the compression bag (B).

The lid member (3) is provided at the upper surface (31) with a corresponding portion (31*a*) which comes into contact with a suction port (N) of an electric vacuum cleaner, and this corresponding portion (31*a*) is provided with a lid member side through-hole (32) communicating with the inner side of the lid member (3) in a region surrounded by the peripheral edge of the suction port (N) when the suction port (N) is brought into contact.

At least a part of the valve body (4) is arranged in a valve body accommodating chamber (S) surrounded by the partition wall (21) of the base member (2) and the lid member (3). This valve body (4) is capable of being sucked to the deflation port (22) by a negative pressure in the compression bag (B) to block the deflation port (22) from the upper side.

When the lid member (3) is loosened and moved upward, the valve body (4) is capable of being pulled toward the lid member (3) by the suction of an electric vacuum cleaner to be separated from the deflation port (22). When the lid member (3) is tightened and moved downward, the valve body (4) maintains the sealing state of the deflation port (22). The screw portion (24*a*) is formed on a side wall (24) provided so as to protrude upward in the base member (2).

On the lower surface of the lid member (3), there is provided a pressing portion (33) for pressing the valve body (4) in accordance with the screwing of the lid member (3). The valve body accommodation chamber (S) is defined by the side wall (24), the partition wall (21), and the lower end of the pressing portion (33) of the lid member (3).

As described above, when the lid member (3) is loosened, a part of the valve body (4) can move in the valve body accommodation space (S) in the vertical direction.

The pressing portion (33) is provided with a pressing ring (33*a*), and the upper end face (33*a*1) of the pressing ring (33*a*) is positioned lower than the upper face (31) of the lid member (3).

The lid member side through-hole (32) is provided with a center side through-hole (32*a*) provided in the pressing ring (33*a*) and a peripheral side through-hole (32*b*) formed in the outer side of the pressing ring (33*a*) in a plan view.

The center side through-hole (32*a*) and the peripheral side through-hole (32*b*) are communicated by the continuous space (32*c*). The continuous space (32*c*) is communicated with the center side through-hole (32*a*) and the peripheral side through-hole (32*b*) at a position lower than the upper surface (31) of the lid member (3) and higher than the pressing ring (33*a*) (see claim 1). Further, Patent Document 2 also discloses a compressing bag equipped with such a deflation valve (see claim 8).

The invention disclosed in Patent Document 2 solves the above-mentioned problems and reduces the number of constituent members of the deflation valve. However, the valve body itself is a member that moves up and down with respect to the base member independently of the lid member. Therefore, further simplification of the structure was expected.

On the other hand, Patent Document 3 shows a valve body integrated with a lid member.

Specifically, FIG. 4 of Patent Document 3 and its paragraphs [0015] to [0023] include the following disclosure. A resin film 4 on one side of a storage bag 2 is provided with a suction port 14 circularly opened, and a check valve 16 made of resin is attached to the suction port 14. The check valve 16 is attached so as to sandwich the opening portion of the suction port 14 from the front and back sides, and is schematically configured by a lower valve case 18 to be fixedly attached to the inner surface side of the storage bag 2, an upper valve case 20 to be fixed to the outer surface side, and a valve body 24 relatively movable up and down with respect to the two valve cases 18 and 20 to open and close the valve hole 22 formed in the lower valve case 18.

The lower valve case 18 includes an annular flange 18*a* to be air-tightly fixed to the inner surface side of the storage bag 2 on the outer peripheral portion of the suction port 14. A cylindrical portion 18*b* is integrally formed with the inner peripheral portion of the flange 18*a*, and the upper end of the cylindrical portion 18*b* projects upward through the suction port and the lower end extends downward than the bottom face of the flange 18*a*.

A valve seat cylinder 18*d* is integrally molded at the lower end of the cylindrical portion 18*b* via an annular shielding plate 18*c* extending inwards, and a guide cylinder 18*f* supported by four ribs 18*e* arranged at equal intervals of 90 degrees is integrally formed on the inner side of the valve seat cylinder 18*d*. The cylindrical portion 18*b*, the valve seat cylinder 18*d*, and the guide cylinder 18*f* are arranged concentrically. The valve seat cylinder 18*d* has an upper end inner peripheral portion serving as a valve seat surface and the inner space of the valve seat cylinder 18*d* serves as a valve hole 22 constituting a part of a suction passage.

The upper valve case 20 is provided with a flange 20*a* facing the flange 18*a* of the lower valve case 18 and an engaging cylinder 20*b* integrally formed on the inner peripheral portion of the flange 20*a* and protruding upward and fitted to the outer periphery of the cylindrical portion 18*b* of the lower valve case 18. An annular engaging groove 20*c* is formed on the inner peripheral surface of the engaging cylinder 20*b* and the engaging groove 20*c* is configured to be engaged with a protrusion 18*g* annularly formed on the outer periphery of the cylindrical portion 18*b* of the lower valve case 18 so as to be fixed to the upper valve case 20. The resin film 4 of the storage bag 2 is sandwiched by and between the flanges of the upper valve case 20 and the lower valve case 18. An upper end portion of the engaging cylinder 20*b* is formed so as to protrude in a ring shape inward than the inner peripheral surface of the cylindrical portion 18*b* of the lower valve case 18, and the protruding portion serves as a stopper portion 20*d* of the valve body 24.

The valve body 24 is composed of a valve cylinder 24*a* which is slidably fitted on the outer periphery of the guide cylinder 18*f* of the lower valve case 18 in a vertically movable manner, a disk-shaped lid portion 24*b* which is formed integrally with the upper end portion of the valve cylinder 24*a* so as to be expanded outward, a stopper piece 24*c* formed to extend downward in a bar shape from the lower surface of the lid portion 24*b*, and rubber seal rings 24*e* attached to an annular groove 24*d* formed at the lower end portion of the outer peripheral surface of the valve cylinder 24*a*.

The stopper pieces 24*c* are provided at equal intervals of 90 degrees on the same circumference and each stopper piece 24*c* is provided at the lower end portion thereof with an engaging claw 24*f* projected radially outward. When the valve body 24 is lifted upward, the engaging claw 24*f* comes into contact with and is engaged with the lower surface of the stopper portion 20*d* at the upper end portion of the engaging cylinder 20*b* of the upper valve case 20, so that the detachment of the valve body 24 can be prevented.

In the above-described lift state, the valve cylinder 24*a* is separated from the valve seat cylinder 18*d* to open the valve hole 22, so that the air in the inner side of the storage bag 2 can be sucked and discharged to the outer side from between the lid portion 24*b* and the locking cylinder 20*b* of the upper valve case 20. On the other hand, in a state in which the valve body 24 is lowered, the tip end of the lower end portion of the valve cylinder 24*a* is fitted into the inner side of the valve seat cylinder 18*d* and the seal ring is seated on the upper surface of the valve seat cylinder 18*d* to maintain the sealing performance. To hold the check valve in a sealed state, the valve body 24 seated on the valve seat cylinder 18*d* is lightly pushed so as to press-fit the seal ring 24*e* to the inner peripheral surface portion of the valve seat cylinder 18*d* into a locked state.

In the suction sealing type compression storage bag 2, a storage item, such as, e.g., bedding, is accommodated in the storage bag 2, and the opening portion thereof is closed with an opening and closing fastener 10 to seal. Thereafter, the valve body 24 of the check valve 16, which is locked and held in the sealed state, is forcibly opened upward once. With this, the seal ring 24*e* of the valve cylinder 24*a* is freely lifted from the valve seat surface of the valve seat cylinder 18*d*, so that the locked state of the valve cylinder 24*a* can be released.

As described above, it can be said that in Patent Document 3, the lid member is provided with the seal ring 24*e* serving as a valve member, so that the structure of the deflation valve disclosed in Patent Document 2 is more simplified.

However, as shown in the paragraph number [0023] and FIG. 4(*b*) in the deflation valve shown in Patent Document 3, it is not easy to release the locked state shown in FIG. 4(*a*) by forcibly opening the valve body 24 of the locking portion 16 locked in a sealed state upward.

Specifically, as shown in FIG. 7(A) attached to the present application, in the deflation valve disclosed in Patent Document 3, the side portion 25 of the lid member (lid portion 24*b*) is not provided with a suitable portion for hooking fingers f in order to pull up the lid member upward (see FIG. 7(B) attached to the present application). Therefore, it is difficult to firmly grasp the lid member with fingertips to release the lock. Even in the case of a user having thinner fingers f, it is difficult to grip and pull up the side portion 25 of the lid member in the locked state shown in Patent Document 3. Even more, for a user having big hands, it is very difficult to grab and pull the side portion 25 of the lid member upward.

It is conceivable to insert a tip of a tool such as a flat-blade screwdriver between the side portion 25 of the lid member and the side portion 26 of the locking cylinder 20*b* to forcibly open it. However, it is troublesome to prepare a tool such as a screwdriver, and the use of a sharp tool also is likely to damage the deflation valve and shorten the life of the compression bag.

It should be noted that the name and number of each part of the deflation valve shown in Patent Documents 1 to 3, including the name and number used for each part of the deflation valve according to Patent Document 3 shown in FIGS. 7A and 7B attached to the present application, have no direct relation with the name and number of each part allotted to the embodiments of the present invention.

The inventor of the present application has conceived to simply form a protrusion on the side portion 25 of the lid portion 24*b* to serve a finger hooking portion or to increase the diameter of the lid portion 24*b* so as to be larger than the outer diameter of the locking cylinder 20*b* so that the side portion 25 of the lid portion 24*b* protrudes like a flange from the side portion of the locking cylinder 20*b* to be easily hooded by fingers f.

However, there is a possibility that the protrusion or the projecting lid portion 24*b* is damaged by a nozzle tip of a vacuum cleaner. In order to suck with a nozzle of a vacuum cleaner, it is necessary to configure such that the lid portion 24*b* can be enter into the suction port of the nozzle, and it is undesirable that the lid portion 24*b* becomes bulky in order to impart the strength. It is also necessary to make the lid member light in weight so that the lid member can be displaced upward by the suction force of a vacuum cleaner.

SUMMARY OF THE INVENTION

The present invention was made to solve the aforementioned problems and aims to provide a deflation valve capable of releasing a locking state by easily pulling a lid member upward without requiring a use of a separate tool, making the lid member heavy, or requiring a complicated configuration.

Therefore, in the present invention (a first aspect of the invention), in a deflation valve for a compression bag in which a base member to be attached to the compression bag and a lid member attached to the upper surface of the base member are provided, the base member has a deflation port for securing airflow between an inner side and an outer side of the compression bag, and the lid member opens and closes the deflation port, a deflation valve having the following structure is provided.

That is, a deflation valve for use with a compression bag includes:

a base member configured to be attached to the compression bag, and a lid member configured to be attached to an upper surface of the base member, wherein:

the base member is provided with a deflation port for securing airflow between an inner side and an outer side of the compression bag, the lid member being configured to open and close the deflation port, the upper surface of the base member is configured to face the outer side of the compression bag, and a lower surface of the base member is configured to face an inner space side of the compression bag, the deflation port is a through-hole penetrating the base member from the upper surface side of the base member to the lower surface side thereof, the base member is provided on the upper surface with a cylindrical inner cylindrical portion which extends the deflation port upward from the upper surface of the base member, the lid member is a cap including a plate-shaped top plate portion and a cylindrical outer cylindrical portion, the top plate portion is provided on its lower surface with a valve member made of a material having elasticity, the material being exemplified by rubber, the outer cylindrical portion is configured to surround the valve member and extend downward from an outer edge of the top plate portion to form a side portion of the lid member, the outer cylindrical portion is provided with an air passage portion for securing airflow between an inner side and an outer side of the outer cylindrical portion, the outer cylindrical portion is arranged outwardly of the inner cylindrical portion so as to be displaced upward and downward with respect to the inner cylindrical portion, when suction of the deflation port via the lid member is performed on the upper surface of the base member, valve opening for detaching the valve member from the deflation port by upwardly displacing the lid member is performed, causing communication of the deflation port with the air passage portion by the valve opening to impart a negative pressure to the inner side of the compression bag by the suction, the lid member is automatically displaced downward by the negative pressure in the compression bag when the suction is stopped, downward displacement of the lid member causes valve closing for closing the deflation port with the valve member, causing suspension of communication between the deflation port and the air passage portion, manually displacing the lid member further downward after the valve closing to fit the valve member to the inner cylindrical portion results in locking of the lid member in the deflation port with elasticity of the valve member, the locking is released by upwardly moving the lid member gripped by hand, and the air passage portion serves as a finger hooking portion to be hooked by a finger when pulling the lid member upward.

Note that the aforementioned rubber or the like includes rubber and those having elasticity and airtightness necessary for sealing, such as soft plastic.

Further, the present invention (a second aspect of the invention) can provide a deflation valve in which the outer cylindrical portion is provided with the air passage portion at at least two positions, and one of the air passage portions is positioned on an opposite side of the other of the air passage portions with respect to a circumferential direction of the inner cylindrical portion with the valve member interposed therebetween so that the lid member is capable of being pulled upward with an index finger and a thumb hooked with the air passage portions.

Further, the present invention (a third aspect of the invention) can provide a deflation valve in which the deflation valve further includes:

a restricting portion formed on an outer peripheral surface of the inner cylindrical portion so as to protrude radially outward of the inner cylindrical portion; and a restricted portion formed on the outer cylindrical portion, wherein:

the restricted portion comes into contact with the restricting portion when the outer cylindrical portion is moved upward with respect to the inner cylindrical portion to prevent detachment of the lid member, and at least one of the air passage portions accommodates the restricting portion as a guide so as to allow upward and downward displacements of the restricting portion relative to the restricted portion, and a lower end of the air passage portion as the guide serves as the restricted portion.

That the restricted portion can be displaced up and down relative to the restricted portion includes the case in which the restricted portion displaces up and down with respect to the restricting portion and the case in which the restricting portion is displaced up and down with respect to the restricted portion.

Further, the present invention (a fourth aspect of the invention) can provide a deflation valve in which the lower surface of the valve member includes a first closing surface formed into an annular shape and a second closing surface provided on a radially outer side or a radially inner side of the first closing surface, the first closing surface is a convex curved surface facing radially outward of the valve member or a concave curved surface facing radially inward of the valve member, and the second closing surface is a substantially flat surface facing downward of the valve member, in the valve closing due to a downward displacement of the lid member which received a negative pressure, the first closing surface of the valve member comes into contact with the inner cylindrical portion, and when the lid member is further pressed downward after the valve closing to forcibly fit the first closing surface on the inner side of the inner cylindrical portion or the outer side of the inner cylindrical portion, the locking is performed and the second closing surface is brought into contact with an upper end face of the inner cylindrical portion to seal the deflation port by the first closing surface and the second closing surface.

Further, the present invention (a fifth aspect of the invention) can provide a deflation valve in which the first closing surface is a convex curved surface facing radially outward of the valve member, the second closing surface is an annular surface provided on an radially outer side of the first closing surface, the valve member includes a fitting portion protruding downward on a radially inner side of the second closing surface, at least a part of the outer peripheral surface of the fitting portion serves as the first closing surface, and when the lid member is pressed after the valve closing to forcibly fit the fitting portion into the deflation port, the locking is performed and the second closing surface is brought into contact with the upper end face of the inner cylindrical portion.

Further, the present invention (a sixth aspect of the invention) can provide a deflation valve in which the outer peripheral surface of the fitting portion is provided at a lower section of the first closing surface with a tapered surface gradually reducing in diameter of the fitting portion toward a lower end of the fitting portion.

Further, the present invention (a seventh aspect of the invention) can provide a deflation valve in which the air passage portion serves as a window through which an upper end of the side portion of the inner cylindrical portion is visually exposed to the outer side of the outer cylindrical portion.

Further, the present invention (an eighth aspect of the invention) can provide a compression bag equipped with any one of the aforementioned deflation valve.

In the present invention, it is configured such that the valve member is attached to the lid member and the valve member is displaced together with the lid member to open and close the deflation port. This enables to simplify the structure of deflation valve and reduce the number of parts. On the premise of the simplification, in the present invention, by using the air passage portions as finger hooking portions, without using a separate tool, making the lid member heavy, and making the configuration complicated, the lock of the lid member to the base member can be easily released by pulling the lid member upward.

Furthermore, according to the present invention (the third aspect of the invention), also for the configuration of regulating the lid member to dropping from the base member, by using the air passage portions, the structure of the deflation valve is simplified and the enlargement of the lid member is prevented.

Further, in the deflation valve disclosed in Patent Document 3, the seal ring 24*e* is a general O-ring, and its cross-section is substantially circular. For this reason, there was a concern that the seal ring 24*e* performed the contact with the base member side only by almost its maximum outer diameter portion and therefore the compression bag was not sealed tightly by the deflation valve during the valve was closed. However, in particular, in the present invention (the fourth aspect of the invention), since the valve member is provided with the first closing surface and the second closing surface different in facing direction, the deflation port can be closed from different directions by the operation of the lid member, which enables assured sealing of the compression bag.

Furthermore, in the invention (the seventh aspect of the invention), through the air passage portions, the positional relationship between the upper end of the inner cylindrical portion and the second closing surface can be visually recognized, which enables to check whether or not the second closing surface is in contact with the inner cylindrical portion. With this check, it can be confirmed whether or not the lock is properly done.

While realizing strong sealing of the deflation port 10 as described above, when opening the deflation port 10, the opening operation can be performed by grabbing the lid member 3 with fingers hooked with the air passage portions 33. As a result, the smooth pull-up operation of the lid member 3 will not be impaired.

EMBODIMENTS FOR CARRYING OUT THE INVENTION

Figure 1A:
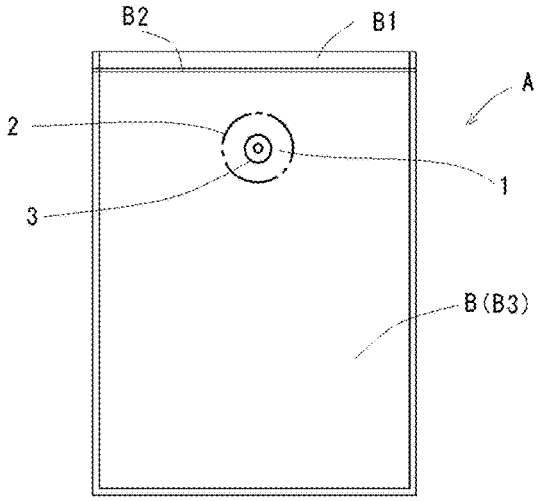
FIG. 1A is an entire plan view of a compression bag according to an embodiment of the present invention.

Hereinafter, preferred embodiments of the present invention will be described with reference to drawings. It should be noted that the term "up and down" in the description is used for the sake of convenience to indicate the relative positional relationship between respective members, and is not intended to limit to an absolute positional relationship in which a direction along which gravity acts is defined as "down" and a direction against which gravity acts is defined as "up".

(Basic Configuration)

The compression bag A of the present invention is provided with a bag body B having airtightness and a size capable of accommodating bedding, clothing, etc., and a deflation valve 1 attached to the bag body B. The deflation valve 1 is equipped with a base member 2 fixed to the bag body B and a lid member 3 formed separately from the base member 2.

In the base member 2, a through-hole penetrating the base member 2 up and down is provided as a deflation port 10 securing airflow between the inner space of the bag body B and the outer side of the bag body B. The lid member 3 is attached to the base member 2 so as not to detach by a restriction mechanism 5. On the back side of the lid member 3, that is, on the lower side of the lid member 3, a valve member 4 is provided.

On the surface of the base member 2, i.e., the upper surface 2*a* of the base member 2, a cylindrical portion which extends the deflation port 10 upward from the upper surface 2*a* of the base member 2 is provided as an inner cylindrical portion 23.

This inner cylindrical portion 23 is a mounting portion for mounting the lid member 3.

The lid member 3 is a cap to be attached to the inner cylindrical portion 23 which is the mounting portion.

The lid member 3 is equipped with a cylindrical outer cylindrical portion 32 surrounding the valve member 4 as a side portion.

The valve member 4 provided on the lower surface of the lid member 3 is surrounded by the cylindrical outer cylindrical portion 32.

The lid member 3 is provided with air passage portions 33 on the radially outer side of the valve member 4. Specifically, the air passage portion 33 is provided in the outer cylindrical portion 32 and is a penetrating portion penetrating from the inner peripheral surface 32*a* of the outer cylindrical portion 32 to the outer peripheral surface of the outer cylindrical portion 32. The air passage portion 33 ensures airflow between the inner space of the outer cylindrical portion 32 and the outer side of the outer cylindrical portion 32 with certainty.

By attaching the lid member 3 to the inner cylindrical portion 23 which is the mounting portion, the lid member 3 can be disposed on the upper surface side of the base member 2 and the outer cylindrical portion 32 can be arranged on the outer cylindrical portion 23. The inner diameter of the outer cylindrical portion 32 is slightly larger than the outer diameter of the inner cylindrical portion 23. For this reason, the outer cylindrical portion 32 has a degree of freedom that can be displaced up and down with respect to the inner cylindrical portion 23. Then, by moving the lid member 3 up and down with respect to the base member 2, the outer cylindrical portion 32 can be displaced up and down with respect to the inner cylindrical portion 23. In accordance with the upward movement of the lid member 3, the valve member 4 equipped to the lid member 3 is displaced upward with respect to the inner cylindrical portion 23 together with the outer cylindrical portion 32, so that the valve member 4 is detached from the upper end opening of the deflation port 10, i.e., the upper end opening 23*b* (see FIG. 3A) of the inner cylindrical portion 23 to open the deflation port 10. In accordance with the downward movement of the lid member 3, the valve member 4 is displaced downward with respect to the inner cylindrical portion 23 together with the outer cylindrical portion 32, so that the valve member 4 closes the upper end opening of the deflation port 10, i.e., the upper end opening 23*b* (see FIG. 3A) of the inner cylindrical portion 23 to close the deflation port 10.

The restriction mechanism 5 is a retaining mechanism of the outer cylindrical portion 32 with respect to the inner cylindrical portion 23. In particular, on the lower surface of the valve member 4, a fitting portion 41 protruding downward from the center of the lower surface of the lid member 3 in a plan view and a flange portion 42 disposed substantially horizontally so as to surround the fitting portion 41 are provided. The outer peripheral surface of the base end portion of the fitting portion 41 serves as a first closing surface 43, and the lower surface of the flange portion 42 serves as a second closing surface 44.

When the first closing surface 43 is displaced upward to be detached from the upper end opening 23*b* of the inner cylindrical portion 23, the aforementioned opening of the deflation valve 1 is performed. When the first closing surface 43 is displaced downward to close the upper end opening of the deflation port 10, that is, the upper end opening 23*b* of the inner cylindrical portion 23, the aforementioned closing of the deflation valve 1 is performed. By further pressing the lid member 3 downward after the closing, the lid member 3 can be locked to the base member 2. By further pressing the lid member 3 downward at the time of the locking or after the locking, the second closing surface 44 can be brought into contact with the upper end face 23*a* of the inner cylindrical portion 23.

When releasing the above locking, it is possible to pull the lid member 3 upward by hooking fingers in the air passage portions 33 with the air passage portions 33 as finger hooking portions.

Hereinafter, the configuration of each part of the compression bag A will be described in detail.

(Bag Body B)

As shown in FIG. 1A, the above-mentioned bag body B is formed by a sheet made of a soft plastic represented by, e.g., polyethylene, nylon, and vinyl, and has airtightness.

In order to communicate the internal space (accommodation space) of the bag body B with the outer side of the bag body B, in other words, in order to open the accommodation space of the bag body B to the outer side of the bag body B1, in addition to the deflation port 10 of the deflation valve 1, the bag body B is provided with an opening portion B1 for taking in and out an accommodation item C such as bedding and clothing. The opening portion B1 is provided with a fastener B2, so that after accommodating an accommodation item C into the bag body B through the opening portion B1, the opening portion B1 can be closed by closing the fastener B2.

Figure 1B:
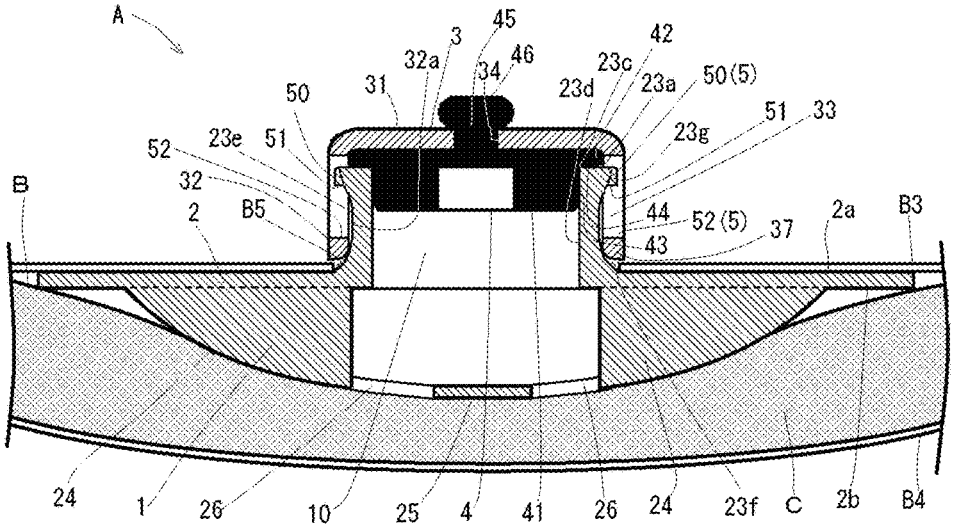
FIG. 1B is a schematic longitudinal cross-sectional view showing a locked state of a deflation valve of FIG. 1A.

As shown in FIGS. 1A and 1B, in this example, the bag body B is formed by arranging two sheets of substantially rectangular shape one on top of the other in a plan view. The rectangular sheets stacked one on top of the other are sealed at three sides of its outer edge to form a bag, and the remaining one side serves as an opening portion B1 of the bag. In place of the above, the above-mentioned sheet may be formed by folding one sheet one on top of the other and sealing two sides. In this example, the two sheets are stacked one on top of the other, and sealed as described above to form a bag body B. Of the above-mentioned stacked two sheets, the upper sheet will be referred to as a sheet B3 and the lower sheet will be referred to as a sheet B4.

In the upper sheet B3, a hole B5 is formed. The hole B5 is an opening portion which penetrates from the upper surface of the upper sheet B3 to the lower surface of the sheet B3 and opens the inner space of the compression bag A to the outer side of the compression bag A.

(Deflation Valve 1)

As shown in FIG. 1B, the deflation valve 1 is attached to the upper surface of the bag body B, that is, the upper sheet B3.

As described above, in the deflation valve 1, the lid member 3 formed separately is attached to the base member 2 fixed to the bag body B.

First, the base member 2 will be described in detail.

The base member 2 is a plastic disk. The deflation port 10 penetrates from the center of the surface of the base member 2 which is a disk, that is, the center of the upper surface of the base member 2 to the center of the back surface of the base member 2, that is, the center of the lower surface of the base member 2, and opens to the front and rear of the base member 2. That is, the deflation port 10 has an upper end opening on the surface of the base member 2 and a lower end opening on the back surface of the base member 2. Since the deflation port 10 is provided, the base member 2 is formed in a donut shape.

On the upper surface of the base member 2, the inner cylindrical portion 23 is positioned at the center of the upper surface. The inner cylindrical portion 23 is a cylindrical portion which protrudes upward than the other portion of the upper surface of the base member 2 at the center of the upper surface.

The inner space of the cylindrical inner cylindrical portion 23 constitutes a section extending upward of the deflation port 10 as a part of the deflation port 10. Therefore, the upper end opening 23*b* of the inner cylindrical portion 23 is the upper end opening of the deflation port 10.

Figure 2A:
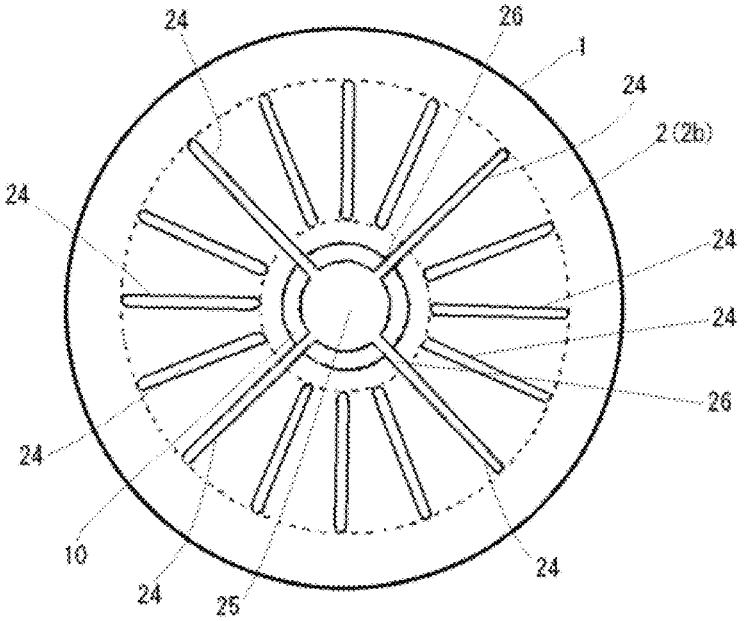
FIG. 2A is a bottom view of the deflation valve shown in FIG. 1B.
Figure 2B:
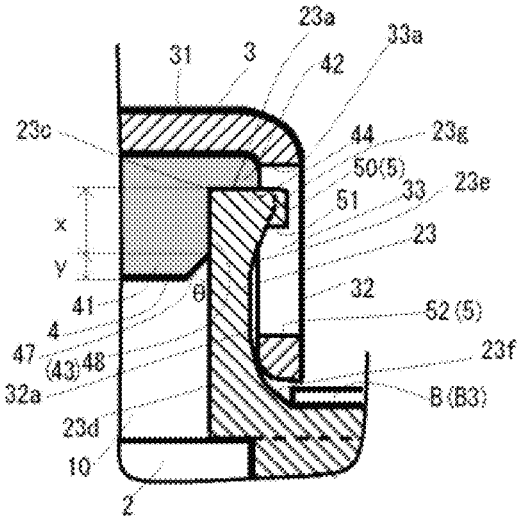
FIG. 2B is an enlarged partial cutaway longitudinal cross-sectional view of a main part of the deflation valve shown in FIG. 1B.

As shown in FIG. 2B, on the base end (lower) side of the outer peripheral surface 23*e* of the inner cylindrical portion 23, a lower large-diameter portion 23*f* having a diameter larger than that of other portions of the inner cylindrical portion 23 in the up and down direction is provided. Specifically, the lower large-diameter portion 23*f* is a portion formed so as to gradually increase the outer diameter of the inner cylindrical portion 23 toward the lower portion of the inner cylindrical portion 23.

At the time of locking the lid member 3, the lower end opening 37 of the outer cylindrical portion 32 of the lid member 3 is engaged with the lower large-diameter portion 23*f*, so that the lower large-diameter portion 23*f* serves as a stopper, enabling the positioning of the lid member 3 at the time of the locking.

Also in this example, on the upper end side of the outer peripheral surface 23*e* of the inner cylindrical portion 23 except for the restricting portion 50 to be described later, an upper large-diameter portion 23*g* having a diameter larger than that of the central portion of the inner cylindrical portion 23 in the up and down direction is provided. The upper large-diameter portion 23*g* is a portion formed so as to gradually increase the outer diameter of the inner cylindrical portion 23 toward the upper side on the outer peripheral surface 23*e* of the inner cylindrical portion 23. When the lower end opening 37 of the outer cylindrical portion 32 of the lid member 3 is engaged with the upper large-diameter portion 23*g*, the upper large-diameter portion 23*g* serves as a stopper, so that positioning of the lid member 3 at the time of opening the valve can be performed.

Note that if it is unnecessary to perform the above-mentioned positioning, it is also possible to implement without providing the lower large-diameter portion 23*f* and/or the upper large-diameter portion 23*g*.

As shown in FIGS. 1B and 2B, on the upper end side of the side portion (outer peripheral surface 23*e*) of the inner cylindrical portion 23, a protruding portion protruding in the radially outward direction of the inner cylindrical portion 23 is provided as a restricting portion 50.

The lower surface of the restricting portion 50 constitutes a restricting surface 51. The restricting surface 51 abuts against the restricted portion 52 provided at the lid member 3, so that it is possible to prevent the lid member 3 or the outer cylindrical portion 32 from being pulled upward from the inner cylindrical portion 23. The restricting portion 50 and the restricted portion 52 constitute the restriction mechanism 5. As for the restricted portion 52, the description will be made in the later description of the air passage portion 33.

Figure 5:
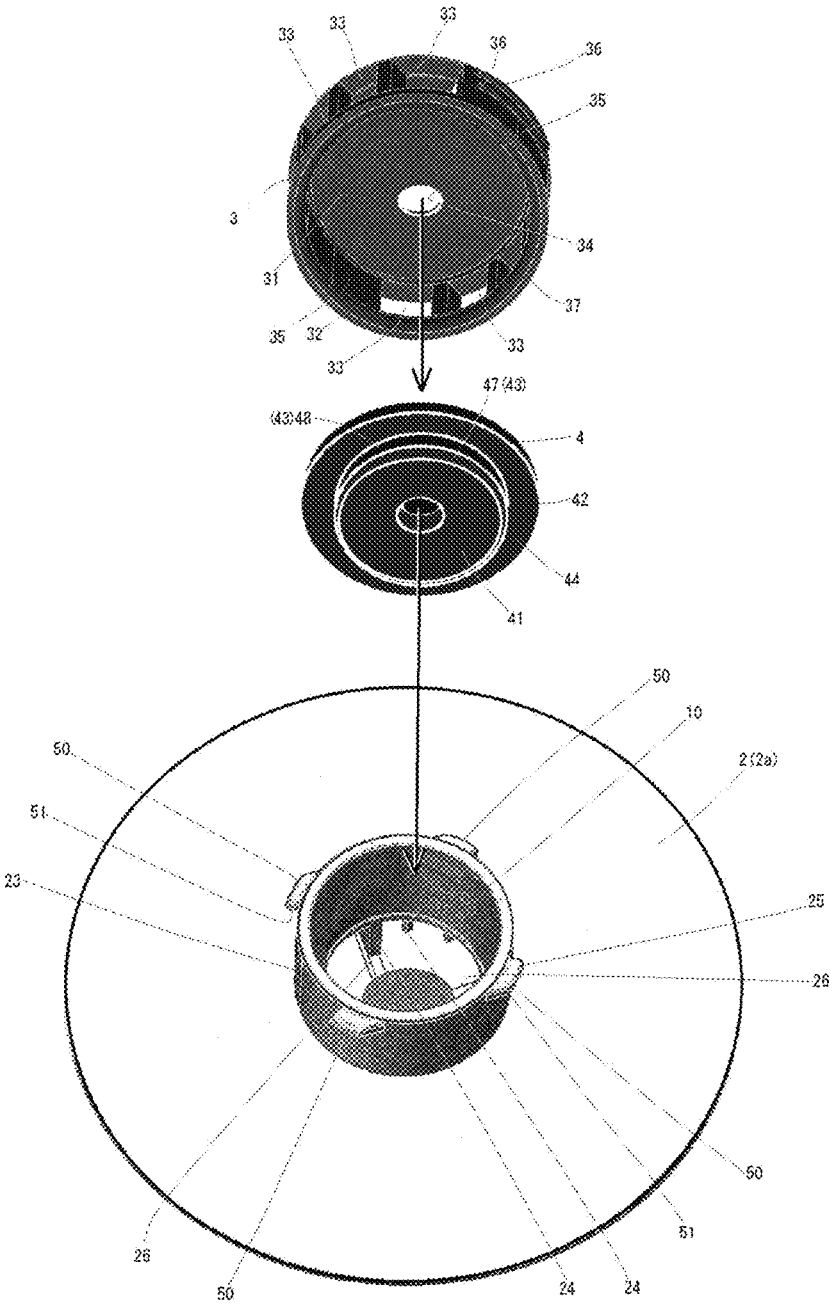
FIG. 5 is an exploded perspective view of the deflation valve shown in FIGS. 1 to 4.

The restricting portion 50 shown in FIG. 5 is a claw-like protrusion protruding from the outer peripheral surface 23*e* of the inner cylindrical portion 23. A plurality of restricting portions 50 are provided at intervals from each other in the circumferential direction of the outer peripheral surface 23*e* from the outer peripheral surface 23*e* of the inner cylindrical portion 23. In this example, four restricting portions 50 are provided. However, if the number of air passage portions 33 as guide portions, which will be described later, permits, five or more restricting portions 50 may be provided, or it is possible to implement by providing three or more restricting portions 50.

The radially outer portion of the inner cylindrical portion 23 on the upper surface 2*a* of the base member 2 is a nozzle receiving surface which comes into contact with a nozzle of a vacuum cleaner at the time of suction of the compression bag A.

The nozzle receiving surface is a flat surface corresponding to a nozzle tip of a suction means.

Figure 3A:
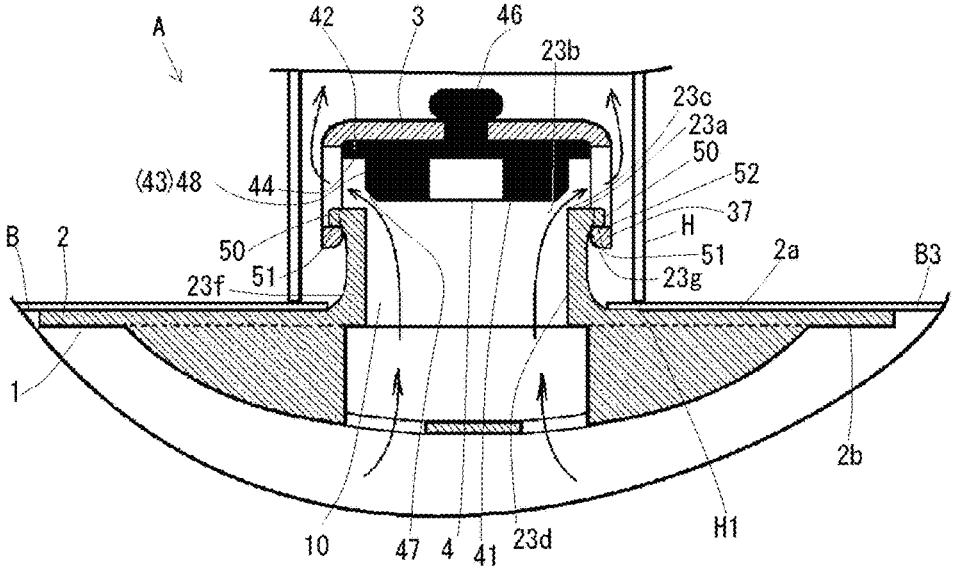
FIG. 3A is a schematic longitudinal cross-sectional view showing a state in which the deflation valve of FIG. 1B is opened by suction using a nozzle of a vacuum cleaner.

In this example, the suction means is a vacuum cleaner, and as shown in FIG. 3A, the nozzle tip of the suction means is an end face of a hose H of a vacuum cleaner, that is, the tip end H1 of the hose H. FIG. 3A shows a state in which the tip end H1 of the hose H is in contact with the nozzle receiving surface.

When using a vacuum cleaner for cleaning, an attachment such as an extension pipe, a brush, a switch for changing a shape of a tip opening, etc., is attached to the tip end H1 of the hose H. However, in the case of performing deflation of the compression bag A, as shown in FIG. 3A, the hose H may be used with the attachment removed. However, as long as the tip end of the attachment can come into contact with the upper surface 2*a* of the base member 2 in a state of accommodating the lid member 3, the attachment may be attached to the hose H or a vacuum cleaner main body to perform the suction. Therefore, the nozzle of the vacuum cleaner mentioned here denotes a tip opening (suction port) of the attachment when the above attachment is used, and denotes the tip end opening (suction port) of the hose H as described above when the attachment is not used.

Attaching the deflation valve 1 to the bag body B will be described. In this example, the base member 2 is accommodated in the inner side of the compression bag A, and the upper surface 2*a* of the base member 2 is fixed to the rear surface of the upper sheet B3, i.e., the lower surface of the upper sheet B3, by a well-known fixing method, such as, e.g., a method of using an adhesive agent, a heat sealing method, and an ultrasonic fixing method. At the time of the fixing, the inner cylindrical portion 23 is protruded from the hole B5 to the outer side of the compression bag A, i.e., protruded from the upper sheet B3 upward. Particularly in this example, the upper surface 2*a* of the base member 2 faces the outer side of the compression bag A via the upper sheet B3 in the bag body B, and the nozzle of the suction means comes into indirectly contact with the base member 2 via the upper sheet B3 of the bag body B. In the present invention, not only in cases where the upper surface 2*a* of the base member 2 comes in direct contact with the nozzle of the suction means but also in cases where the upper surface 2*a* of the base member 2 comes indirectly contact with the nozzle of the vacuum cleaner as described above, both cases are included in the meaning of a contact between the nozzle of the vacuum cleaner and the upper surface 2*a* of the base member 2. The upper surface 2*a* of the base member 2 may be arranged on the outer side of the bag body B (see FIG. 6A), but as described above, it may be configured to be arranged on the inner space side of the bag body B so as to face the outer side of the bag body B via the upper sheet B3.

In order to enable a nozzle of a suction means to bring into contact with the nozzle receiving surface, the outer diameter of the base member 2 is set to be larger than the inner diameter of the nozzle of the suction means, in this example, the inner diameter of the tip end H1 of the hose H of the vacuum cleaner, and the outer diameter of the inner cylindrical portion 23 is set to be smaller than the inner diameter of the tip end H1 of the hose H of the vacuum cleaner.

Further, except for the portion constituting the restriction mechanism 5, the lower large-diameter portion 23*f*, and the upper large-diameter portion 23*g*, the outer diameter of the inner cylindrical portion 23 is smaller than the inner diameter of the outer cylindrical portion 32 of the lid member 3 as described above. Needless to say, the outer diameter of the lid member 3 is smaller than the inner diameter of the nozzle of the suction means, i.e., the inner diameter of the tip end H1 of the hose H of the vacuum cleaner.

As shown in FIGS. 1B and 2A, on the lower surface 2*b* of the base member 2, a plurality of isolation raised portions 24 are provided at intervals. Each of the isolation raised portions 24 is a plate-like portion provided in a state of standing upright from the lower surface 2*b* of the base member 2.

As shown in FIG. 2A, the plurality of isolation raised portions 24 are radially arranged so as to surround the lower end opening of the deflation port 10 at the center of the lower surface 2*b* of the base member 2, and each isolation raised portion 24 extends from the lower end opening side of the deflation port 10 in the radially outward direction of the base member 2.

In order to prevent an accommodation item C and/or the lower sheet B4 from blocking the lower end opening of the deflation port 10 by the aforementioned suction during compression of the compression bag A, each isolation raised portion 24 is provided as a spacer which keeps the accommodation item C and the lower sheet B4 away from the lower end opening of the deflation port 10. And the space between the adjacent isolation raised portions 24 constitutes an airflow path at the time of the suction (see the arrow in FIG. 2A).

In this example, as shown in FIG. 1B, the isolation raised portion 24 is formed so as to gradually increase the protrusion width, that is, increase the protrusion width in the downward direction, from the radially outer side of the base member 2 toward the deflation port 10 at the center.

As shown in FIG. 1B, FIG. 2A, and FIG. 5, in this example, a bridge portion 26 crossing the deflation port 10 is provided between some isolation raised portions 24.

Specifically, in the two isolation raised portions 24 forming a straight line with the deflation port 10 arranged therebetween, the bridge portion 26 is arranged between the ends on the deflation port 10 side. The bridge portion 26 connects the tip portions of both the isolating raised portions 24. As shown in FIG. 2A, in this example, there are two pairs of isolation raised portions 24 to each pair of which the bridge portion 26 is bridged, and the two bridge portions 26 intersect so as to present a cross in a plan view. At the intersection portion of the bridge portions 26, a protector portion 25 of a circular shape, or a disk shape in a plan view is formed. This protector portion 25 can assuredly prevent the entering of the accommodation item C from the lower end opening of the deflation port 10 into the compression bag A by the suction from above the deflation port 10.

Next, the lid member 3 will be described in detail.

As shown in FIGS. 1B and 2B, the lid member 3 has a disk-shaped top plate portion 31. The outer cylindrical portion 32 is a cylindrical portion protruding downward from the outer edge of the top plate portion 31, and the outer cylindrical portion 32 constitutes the side portion of the lid member 3 as described above.

That is, the upper end of the outer cylindrical portion 32 is closed by the top plate portion 31. The lid member 3 is a plastic cap and is configured to be placed on the inner cylindrical portion 23 so that the outer cylindrical portion 32 overlaps the outer side of the outer cylindrical portion 23 as described above.

The valve member 4 is provided on the lower surface of the top plate portion 31 of the lid member 3.

The above-mentioned valve member 4 is formed by a material having elasticity (hereinafter referred to as "elastic body" as required). In this example, the valve member 4 is made of rubber which is an elastic body. However, it is possible to form the valve member 4 by an elastic body other than rubber as long as it has elasticity and airtightness necessary for sealing, such as soft plastic having flexibility.

As shown in FIG. 1B, the valve member 4 is provided at its upper surface with a fixing portion 45. Although the fixing portion 45 may be configured by an adhesive or other well-known fixing structures capable of fixing the valve member 4 to the lower surface of the top plate portion 31. In this example, the fixing portion 45 is a protrusion extending upward from the upper surface of the valve member 4. The tip end side of the fixing portion 45 is provided with a head portion 46 having a diameter larger than a diameter of the base end side. The top plate portion 31 is provided with a mounting hole 34 having a diameter smaller than the diameter of the head portion 46. The mounting hole 34 is a hole penetrating the top plate portion 31 up and down. By deforming the valve member 4 using the elasticity of the valve member 4, the fixing portion 45 is forcibly fitted into the mounting hole 34 from below the top plate portion 31. Then, by exposing the head portion 46 to the upper surface side of the top plate portion 31, the head portion 46 is caught by the top plate portion 31, so that the valve member 4 is fixed to the top plate portion 31.

In this example, the fitting portion 41 of the valve member 4 is a substantially columnar body tapered at the tip end outer circumference, i.e., the lower end outer circumference.

The flange portion 42 extends to the radially outward of the base portion of the fitting portion 41. As described above, the outer peripheral surface of the fitting portion 41 serves as the first closing surface 43. The lower surface of the flange portion 42 is a flat surface, and the lower surface of the flange portion 42 serves as the second closing surface 44.

In this example, in detail, the fitting portion 41 is composed of a columnar portion formed in a columnar shape and a truncated cone portion formed in a truncated cone shape. The columnar portion is the main part of the fitting portion 41, and the truncated cone portion is continuously formed from the columnar portion downward. The outer peripheral surface of the fitting portion 41 is composed of an outer peripheral surface of the cylindrical portion, i.e., a cylindrical surface 48 and an outer peripheral surface of the truncated cone portion, i.e., a tapered surface 47.

In this example, the cylindrical surface 48 constitutes the first closing surface 43.

In a side view of the valve member 4, the above-mentioned cylindrical surface 48 which is the first closing surface 43 is a surface in which an included angle between the first closing surface 43 and the second closing surface 44 is substantially a right angle.

When the outer peripheral surface of the fitting portion 41 serves as the first closing surface 43 and the lower surface of the flange portion 42 serves as the second closing surface 44, the first closing surface 43 is formed in a convex curved surface (a cylindrical surface 48) facing in the lateral direction of the lid member 3, and the second closing surface 44 is formed in a plane facing downward from the lower surface of the lid member 3.

Further, by providing the tapered surface 47, the tip end side of the fitting portion 41 is tapered downward of the fitting portion 41. The tapered surface 47 facilitates the entry of the fitting portion 41 into the inner cylindrical portion 23, resulting in smooth valve closing.

More specifically, in the valve member 4, the outer diameter of the tip end (lower end) of the truncated corn portion of the fitting portion 41 is smaller than the diameter of the inner peripheral surface 23*d* of the inner cylindrical portion 23, particularly the diameter of the upper end opening 23*b* of the inner cylindrical portion 23. The outer diameter of the cylindrical portion of the fitting portion 41 is larger than the diameter of the inner peripheral surface 23*d* of the inner cylindrical portion 23, in particular, the diameter of the upper end opening 23*b*.

The outer diameter of the base end of the fitting portion 41 coincides with the inner diameter of the annular flange portion 42 surrounding the fitting portion 41. Needless to say, the outer diameter of the flange portion 42 is larger than the inner diameter of the upper end opening 23*b* of the inner cylindrical portion 23. In this example, the outer diameter of the flange portion 42 is substantially the same as the outer diameter of the upper end face 23*a* of the inner cylindrical portion 23. Other than this, the outer diameter of the flange portion 42 may be set to be slightly larger than the outer diameter of the upper end face 23*a* of the inner cylindrical portion 23. To the contrary, the outer diameter of the flange portion 42 may be set to be slightly smaller than the outer diameter of the upper end face 23*a* of the inner cylindrical portion 23 within the range that the sealing by the second closing surface 44 at the time of locking is not impaired.

In particular, in this example, the height x of the cylindrical portion of the fitting portion 41 and the height y of the conical portion are set to x:y=3:0.5. Specifically, the height y of the cone portion is 0.5 mm with respect to the height x (3 mm) of the cylindrical portion. Also in this example, the angle θ of the outer peripheral surface of the conical portion with respect to the outer peripheral surface of the cylindrical portion is about 45 degrees. In other words, the included angle (180 degrees-θ) between the first closing surface 43 and the tapered surface 47 is an obtuse angle of 135 degrees. However, it should be noted that the dimensions and angles of the respective parts of the valve member 4 are exemplifications, and any other dimensions and angles can be adopted as long as the interior of the inner cylindrical portion 23 can be properly closed and the above-mentioned closing can be reliably performed. In this example, as described above, the fitting portion 41 is configured by the cylindrical portion on the base end side and the truncated cone portion on the tip end side. Other than the above, as long as it is possible to properly close the inner side of the inner cylindrical portion 23 and securely close the valve, the entire fitting portion 41 may be formed in a truncated cone shape, or the entire outer peripheral surface of the fitting portion 41 serving as the first closing surface 43 may be formed into a tapered surface.

Figure 3B:
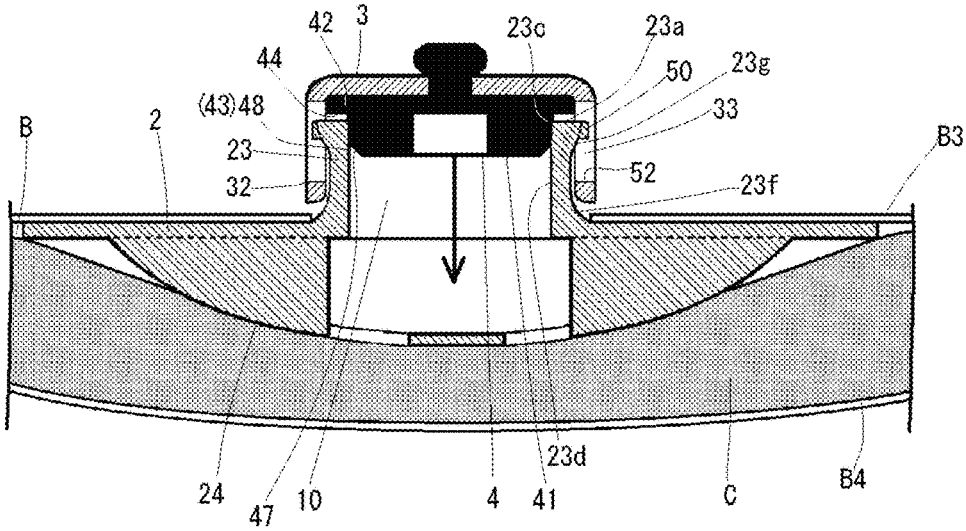
FIG. 3B is a schematic longitudinal cross-sectional view showing a state in which the deflation valve of FIG. 3A is closed by stopping the suction.

As shown in FIG. 3B, the lid member 3 receives a negative pressure in the compression bag A after stopping the suction through the deflation port 10. Along with the lid member 3 which received the negative pressure, the valve member 4 moves downward and performs valve closing to close the deflation port 10. When closing the valve before locking, the tip end (lower end) side of the fitting portion 41 enters the inner cylindrical portion 23 from the upper end opening 23*b* (FIG. 3A) of the inner cylindrical portion 23, and the first closing surface 43 comes in contact with the edge 23*c* of the upper end opening 23*b* of the inner cylindrical portion 23, i.e., the corner where the upper end face 23*a* of the inner cylindrical portion 23 and the inner peripheral surface 23*d* intersect. The edge 23*c* of the upper end opening 23*b* of the inner cylindrical portion 23 bites into the first closing surface 43, which enables assured closing of the valve.

After closing the valve by the negative pressure in the compression bag A, the fitting portion 41 is pushed further downward by hand to allow the fitting portion 41 to move deeper into the inner cylindrical portion 23, so that as shown in FIG. 1B, the lid member 3 can be locked to the base member 2 by the elasticity of the fitting portion 41.

The fitting portion 41 is forcibly fitted into the upper end opening 23*b* of the inner cylindrical portion 23, and the surfaces of the first closing surface 43 and the inner peripheral surface 23*d* of the inner cylindrical portion 23 are brought into close contact with each other due to the radial compression deformation of the fitting portion 41 press-fitted during the locking.

That is, in the locked state, the first closing surface 43 is assuredly pressed against the inner peripheral surface 23*d* of the inner cylindrical portion 23 by the elasticity of the fitting portion 41. By the lock, it is possible to more reliably achieve close contact between the surfaces, that is, the outer peripheral surface of the fitting portion 41, i.e., the first closing surface 43 which is a convex curved surface (tapered surface) and the inner peripheral surface of the inner cylindrical portion 23 which is a concave curved surface. Accordingly, by the locking, it is possible to ensure a larger contact area between the fitting portion 41 and the inner cylindrical portion 23 more surely and to secure higher airtightness. Also, by the aforementioned locking, the airtightness can be maintained.

As described above, by forcibly fitting the fitting portion 41 in a valve closed state into the inner cylindrical portion 23 to lock the lid member 3 to the base member 2, or by further pressing the fitting portion 41 downward after the locking, the second closing surface 44 can be brought into contact with the upper end face 23*a* of the inner cylindrical portion 23 as shown in FIGS. 1B and 2B. That is, by forcibly fitting the fitting portion 41 into the inner cylindrical portion 23, the deflation port 10 can be hermetically closed on two surfaces different in orientation, the first closing surface 43 and the second closing surface 44.

Further, when the fitting portion 41 further deeply enters into the inner side of the inner cylindrical portion 23 due to the locking after valve closing and the second closing surface 44 comes into contact with the upper end face 23*a* of the inner cylindrical portion 23, the edge 23*c* of the upper end opening 23*b* of the inner cylindrical portion 23 is positioned at the corner between the first closing surface 43 and the second closing surface 44.

However, when the corner at which the aforementioned edge 23*c* or the upper end face 23*a* of the inner cylindrical portion 23 and the inner peripheral surface 23*d* intersect is cut off or rounded, the first closing surface 43 may be configured such that the first closing surface 43 comes into contact with the inner peripheral surface 23*d* of the inner cylindrical portion 23 but does not come into contact with the edge 23*c* of the upper end opening 23*b* of the inner cylindrical portion 23.

The contact positions of the first closing surface 43 and the second closing surface 44 is allowed to slightly deviate from the above-described respective positions of the inner cylindrical portion 23 due to the deformation caused by the fitting of the fitting portion 41 into the inner cylindrical portion 23.

Especially, when the first closing surface 43 and the second closing surface 44 continued from the first closing surface 43 seamlessly come into close contact with the upper end face 23*a* of the inner cylindrical portion 23 and the edge 23*c* of the upper end opening 23*b*, it is possible to seal the compression bag A more effectively.

In the aforementioned valve closing before locking, even if the cylindrical portion of the fitting portion 41 has not yet entered into the inner cylindrical portion 23 and the fitting portion 41 remains in a state in which the tapered surface 47 and the edge 23*c* of the inner cylindrical portion 23 are in contact, the locking assuredly enables entering of the cylindrical portion of the fitting portion 41 into the inner cylindrical portion 23.

For example, the tapered surface 47 and the cylindrical surface 48 may be set so as to form the first closing surface 43. In this case, even when the tapered surface 47 is in contact with the edge 23*c* of the inner cylindrical portion 23 and the cylindrical surface 48 has not come into contact with the inner cylindrical portion 23 in the valve closing before locking, the cylindrical portion enters into the inner cylindrical portion 23 and the cylindrical surface 48 comes into contact with the edge 23*c* or the inner peripheral surface 23*d* of the inner cylindrical portion 23 by the locking.

Also, by setting the elasticity by setting the dimension of each part of the valve member 4 and/or selecting the material, from the beginning, it may be configured such that only the tapered surface 47 constitutes the first closing surface 43, the cylindrical surface 48 does not come into contact with the inner cylindrical portion 23 in the closed state caused by the negative pressure in the compression bag A before locking, and the cylindrical surface 48 comes into contact with the edge 23*c* and/or the inner peripheral surface 23*d* of the inner cylindrical portion 23 by the locking.

The outer cylindrical portion 32 is provided with a plurality of air passage portions 33.

Some air passage portions 33 serve as guide portions for accommodating the restricting portion 50 and guide the restricting portion 50 so as to move up and down relative to the outer cylindrical portion 32. In this example, the outer cylindrical portion 32 moves up and down with respect to the restricting portion 50. Different from the guide portion of the outer cylindrical portion 32 which moves up and down, the restricting portion 50 defines the upper limit of the movement of the inner cylindrical portion 23 in the guide portion.

The lower surface of the restricting portion 50 is defined as the restricting surface 51 as described above, and the lower end face (lower edge 33*d*) of the air passage portion 33 serving as the guide portion is defined as the restricted portion 52. As described above, when the restricting surface 51 of the restricting portion 50 comes into contact with the restricted portion 52, the outer cylindrical portion 32 can be prevented from coming off the inner cylindrical portion 23.

The restricting portion 50, which is a protruded portion, becomes an obstacle when attaching the lid member 3 to the base member 2. However, the attachment of the lid member 3 to the inner cylindrical portion 23 may be performed by forcibly inserting the lid member 3 into the inner cylindrical portion 23 of the base member 2 while deforming the restricting portion 50 and/or the outer cylindrical portion 32 by utilizing the elasticity of the lid member 3 made of plastic and the elasticity of the restricting portion 50 of the inner cylindrical portion 23 made of plastic.

The outer cylindrical portion 32 of the lid member 3 is provided with a plurality of air passage portions 33 as described above, that is, the outer cylindrical portion 32 is provided with the air passage portions 33 in at least two positions. Both air passage portions 33 are arranged at different positions with respect to the circumferential direction r (see FIG. 4B) of the outer cylindrical portion 32. Specifically, one of the air passage portions 33 is arranged on the opposite side of the other air passage portion 33 across the valve member 4 in the circumferential direction of the outer cylindrical portion 32. With this arrangement, it is possible to hook the index finger to one of the air passage portions 33 and hook the thumb to the other air passage portion 33 to lift the lid member 3 (see FIG. 4A). As a result of this pulling up, the first closing surface 43 and the second closing surface 44 of the valve member 4 can be disengaged from the inner cylindrical portion 23, so that the lock can be released.

Figure 4A:
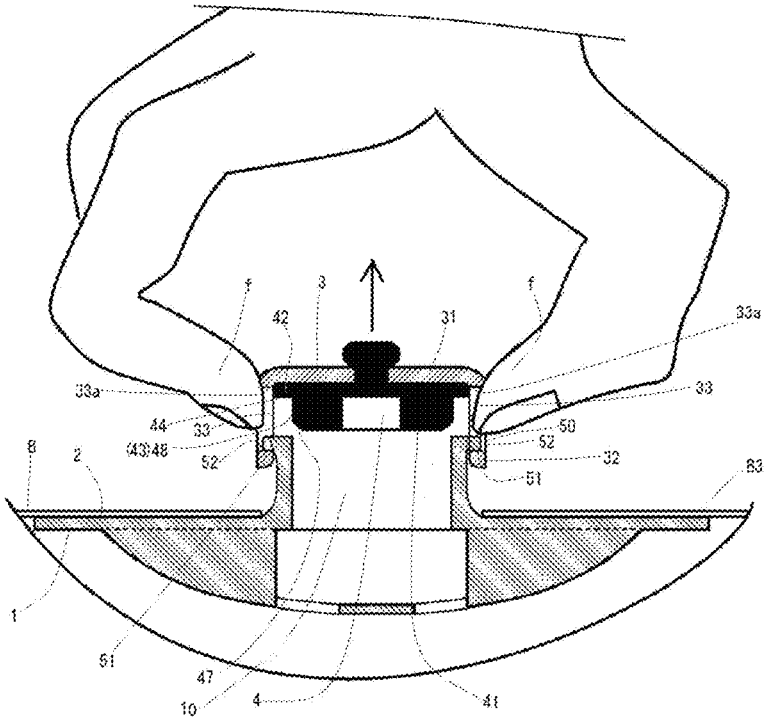
FIG. 4A is a schematic longitudinal cross-sectional view showing a state of releasing the lock of the deflation valve shown in FIG. 1B.
Figure 4B:
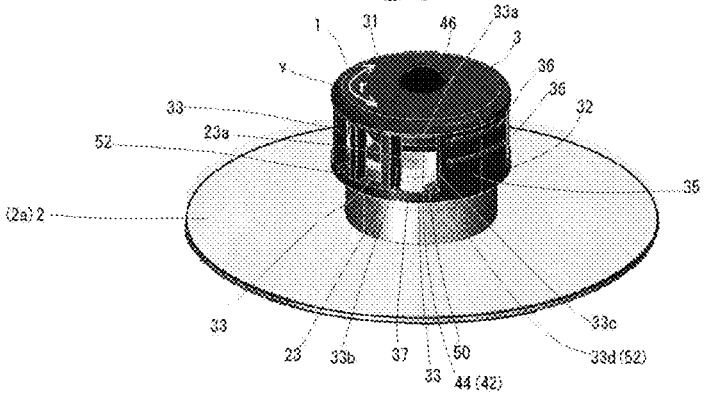
FIG. 4B is a perspective view of the deflation valve of FIG. 4A after releasing the lock.

As shown in FIGS. 4B and 5, in this example, the lid member 3 is provided with six air passage portions 33 arranged in the circumferential direction r of the outer cylindrical portion 32. Each of the air passage portions 33 is an opening portion which opens the inner side of the outer cylindrical portion 32.

Of the six air passage portions 33, three air passage portions 33 adjacent to each other are defined as one group and the remaining three air passage portions 33 are defined as another group. The first group is located on the opposite side of another group across the valve member 4. The distance between the two groups of the air passage portions 33 is larger than the distance between the adjacent air passage portions 33 in each group, and between the groups the outer cylindrical portion 32 serves as a closing side portion 35 of the outer cylindrical portion 32.

As shown in FIG. 4B, the closing side portion 35 may be provided with a ridge 36 extending along the circumferential direction r to provide a second finger hooking portion. In cases where the second finger hooking portion is provided, the raised width of the ridge 36 is limited because the lid member 3 needs to be placed in a nozzle of a vacuum cleaner. Accordingly, also in cases where the second finger hooking portion is provided in the closing side portion 35, the air passage portion 33 is formed as the first finger hooking portion. By using the air passage portion 33 as the finger hooking portion, it is not required to configure to provide any portion protruding outward of the lid member 3, and therefore there is no need to worry about a nozzle of a vacuum cleaner. Furthermore, even if the ridge 36 wears out due to the contact with a nozzle of a vacuum cleaner or the like and fails to serve as a finger hooking portion, the air passage portion 33, which is a penetration portion, will not lose the function as a finger hooking portion due to the wear.

The lid member 3 is provided with the above-mentioned outer cylindrical portion 32 extending downward from the top plate portion 31, so that the air passage portion 33 serving as the first finger hooking portion and the closing side portion 35 serving as the second finger hooking portion can secure the vertical width necessary for hooking a finger in the up and down direction. The number of the air passage portions 33 can be changed and is not limited to the above six exemplified above, and it can be implemented even with 2 to 5 air passage portions 33. If the space of the outer cylindrical portion 32 permits, it is also possible to implement with 7 or more air passage portions 33. For example, the one group of the air passage portions 33 may be configured by two air passage portions 33, or may be configured by four or more air passage portions 33.

In this example, as shown in FIG. 4B, each air passage portion 33 is a substantially rectangular window framed by an upper edge 33*a*, a left edge 33*b*, a right edge 33*c*, and a lower edge 33*d*. However, the air passage portion 33 may also be implemented as an oblong window extending up and down. Further, the air passage portions 33 not serving as a guide portion of the restricting portion 50 are not limited to a rectangle shape or an ellipse shape, but may be of any polygonal shapes other than a regular circle shape and a rectangular shape, and furthermore, shapes other than a circular shape and a polygonal shape may be adopted.

In the air passage portion 33 serving as the guide portion of the restricting portion 50, the lower edge 33*d* of the air passage portion 33 serves as the restricted portion 52.

The width of the air passage portion 33 of the outer cylindrical portion 32 serving as the guide portion of the restricting portion 50 in the axial direction, i.e., the up and down direction, is set to a size capable of displacing the restricted portion 52 with respect to the restricting portion 50 in a range that enables the lid member 3 to open, close and lock. That is, the distance between the upper edge 33*a* and the lower edge 33*d* of the air passage portion 33 serving as the guide portion is set to a size enabling the guide of the restricting portion 50.

In this example, all the air passage portions 33 have substantially the same width between the upper edge 33*a* and the lower edge 33*d*. Other than the above, the air passage portion 33 serving as the guide portion can be implemented even if the distance between the upper and lower sides 33*a* and 33*d* is larger than that of the air passage portion 33 not serving as the guide portion. If the guide is operable, on the contrary to the above, the air passage portion 33 serving as the guide portion may be implemented even if the interval between the upper and lower sides 33*a* and 33*d* is smaller than that of the air passage portion 33 not serving as the guide portion.

Further, in this example, in order to accommodate the restricting portion 50, the air passage portion 33 serving as the guide portion is configured to have a width between the left and right edges 33*b* and 33*c* larger than the width of the air passage portion 33 not serving as the guide portion. However, if the accommodation and guide of the restricting portion 50 can be performed, it is also possible to make the width between the left and right edges 33*b* and 33*c* in all air passage portions 33 substantially equal.

As shown in FIGS. 1B and 4B, each air passage portion 33 is a window that opens the outer cylindrical portion 32, and is formed so that the upper end face 23*a* of the inner round portion 23 can be visually recognized through the respective air passage portions 33 from the outer side of the outer cylindrical portion 32. That is, the positional relationship between the second closing surface 44 of the flange portion 42 and the inner cylindrical portion 23 can be grasped from the outer side of the outer cylindrical portion 32 through each air passage portion 33. More specifically, by looking through the air passage portion 33 to visually confirm that the second closing surface 44 is in contact with the upper end face 23*a* of the inner cylindrical portion 23, it can be determined whether or not the above locking is properly performed. Further, if the fitting portion 41 is not properly fitted to the inner cylindrical portion 23, for example, if it is inclined, it is possible to confirm that the second closing surface 44 is separated from the upper end face 23*a* of the inner cylindrical portion 23 through some air passage portions 33. By looking at each of the air passage portions 33, it is possible to visually recognize whether or not the second closing surface 44 is in contact with the upper end face 23*a* of the inner cylindrical portion 23 and check whether or not the locking is properly performed. If a gap is found between the upper end face 23*a* of the inner cylindrical portion 23 and the second closing surface 44 of the flange portion 42 by the check, the lid member 3 may be locked again. It is preferable to make the color of the valve member 4 and the color of the inner cylindrical portion 23 different from each other so that the visual recognition through the air passage portion 33 can be performed easily. For example, it is preferable to make the valve member 4 a dark color, the inner cylindrical portion 23 a light color, or the valve member 4 a light color and the inner cylindrical portion 23 a dark color. Alternatively, color-coding of the valve member 4 and the inner cylindrical portion 23 may be performed by changing coloring or shading.

It may be configured such that the air passage portion 33 is not provided with the lower edge 33*d*, that is, the air passage portion 33 is formed as a notch provided on the lower end side of the outer cylindrical portion 32. However, as shown in FIGS. 4B and 5, it is preferable to provide a bridge portion 37. The bridge portion 37 is a portion bridging between the lower ends of the left and right edges 33*b* and 33*c*, and the upper surface of the bridge portion 37 serves as the lower edge 33*d*. By providing the bridge portion 37, the lower end of the outer cylindrical portion 32 can be made into a continuous portion in the circumferential direction of the outer cylindrical portion 32. As a result, even if the lid member 3 is not made bulky or heavy, it is possible to give a strength capable of suppressing deformation of the outer cylindrical portion 32 when a locking force or a releasing force is applied to the lid member 3.

(Summary of Operation of Deflation Valve 1)

When using the compression bag A, an accommodation item C such as bedding or clothing is accommodated in the bag body B from the opening portion B1 and the fastener B2 is closed. At this time, the lid member 3 is pulled upward with respect to the base member 2 of the deflation valve 1 to attain the lock released state in which the valve member 4 is removed from the inner cylindrical portion 23 (see FIG. 4A). When releasing the lock, it is convenient if the lid member 3 is engaged with the upper large-diameter portion 23*g* of the inner cylindrical portion 23 in this example to maintain the position of the lid member 3 in the valve open state.

After releasing the lock, as shown in FIG. 3A, with a tip end H1 of a hose H of a vacuum cleaner facing downward, the tip end H1 of the hose H is pressed against the nozzle receiving surface which is the upper surface 2*a* of the base member 2, and the lid member 3 is accommodated together with the inner cylindrical portion 23 in the opening of the tip end H1 of the hose, i.e., in the nozzle of the vacuum cleaner.

With the inner cylindrical portion 23 and the lid member 3 accommodated in the tip end H1 of the hose H as described above, the vacuum cleaner is activated to perform the suction of the deflation valve 1. As shown in FIG. 3A, by this suction, the air in the bag body B is sucked into the hose H via the air passage portions 33 through the deflation port 30, and a negative pressure is imparted to the compression bag A. As a result of the suction, the compression bag A is reduced in volume.

During the suction, the lid member 3 is in a position upwardly moved within the range allowed by the restriction mechanism 5, and the valve member 4 is in a state detached from the inner cylindrical portion 23.

Even if the upper large-diameter portion 23*g* is not provided and therefore the lid member 3 descends to the inner cylindrical portion 23 side due to its own weight before the suction and after releasing the lock member, so that the valve member 4 comes into contact with the inner cylindrical portion 23, it may be configured such that the lid member 3 is automatically moved upward by the suction and the valve member 4 is detached from the upper end opening 23*b* (see FIG. 3A) of the inner cylindrical portion 23 to open the deflation port 10. Also, even if the lid member 3 is engaged with the lower large-diameter portion 23*f*, it is only necessary to configure such that the lid member 3 can be removed from the lower large-diameter portion 23*f* upward by the suction.

After compressing the bag body B together with the accommodation item C, which is bedding or clothing, that is, after completion of the volume reduction of the compression bag A, the suction by the vacuum cleaner is stopped.

After stopping the suction, as shown in FIG. 3B, the lid member 3 automatically moves downward with a negative pressure in the compression bag A, and the valve member 4 closes the deflation port 10. That is, the first closing surface 43 comes into contact with at least the edge 23*c* of the upper end opening 23*b* of the inner cylindrical portion 23 by the suction stop, and therefore the deflation port 10 is automatically closed.

After stopping the suction, the tip end H1 of the hose H is removed from the deflation valve 1 and the lid member 3 in the closed state is further pushed down by hand as described above so that the fitting portion 41 further advances toward the back of the inner cylindrical portion 23. By the advance movement by the pressing, as shown in FIG. 1B, it is possible to lock the lid member 3 to the base member 2 with the first closing surface 43 assuredly pressed against the inner peripheral surface 23*d* of the inner cylindrical portion 23.

By the locking or by further pressing the lid member 3 after the locking, the second closing surface 44 can be brought into contact with the upper end face 23*a* of the inner cylindrical portion 23 as shown in FIG. 2B.

By sealing the compression bag A with the first closing surface 43 and the second closing surface 44 after locking, it is possible to maintain the state of accommodating the accommodation item C in a volume reduced state for a long time.

In this example, a negative pressure is supplied to the compression bag A using a vacuum cleaner to reduce the volume. However, besides this, it can be carried out by sucking with a dedicated pump or a compressor to supply a negative pressure to the compression bag A.

Retrieving the accommodation item C from the compression bag A can be performed by opening the fastener B2 of the bag body B and taking out the accommodation item C through the opening portion B1. Prior to taking out the accommodation item C, the deflation valve 1 is opened, that is, as shown in FIG. 4A, the lid member 3 is gripped with fingers hooked with the air passage portions 33 and pulled up from the base member 2 so that the first closing surface 43 and the second closing surface 44 of the valve member 4 are detached from the inner cylindrical portion 23. With this, the outer side air can be introduced into the compression bag A from the air passage portions 33 via the deflation port 10 to eliminate the negative pressure of the compression bag A. As a result, it is possible to easily retrieve the accommodation item from the compression bag A.

When pulling up the lid member 3, by gripping the lid member 3 with fingers engaged with non-guide portions, i.e., the air passage portions 33 not accommodating the protrusions 50, it is possible to smoothly lift the lid member 3 without being disturbed by the protrusions 50.

MODIFIED EXAMPLE

Figure 6A:
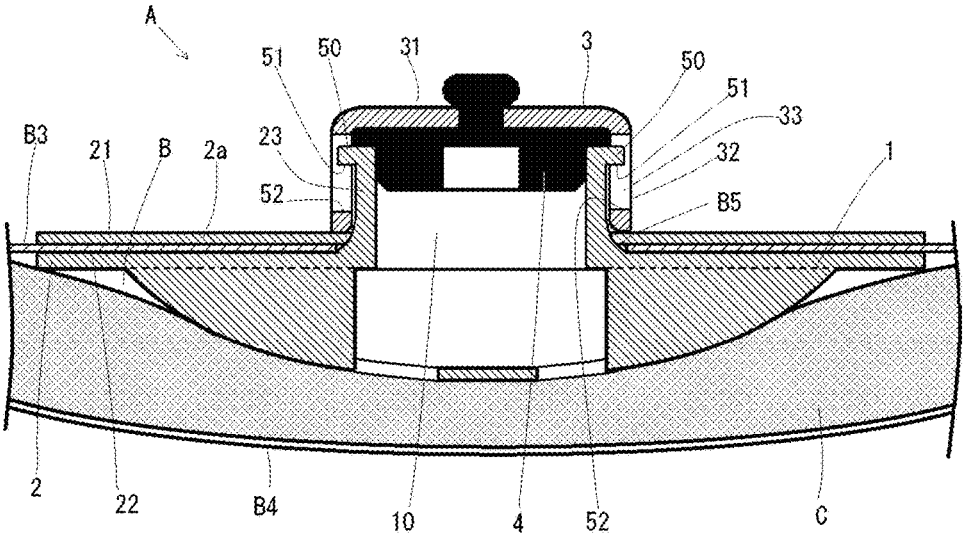
FIG. 6A is a schematic longitudinal cross-sectional view showing another embodiment of a deflation valve according to the present invention.

As shown in FIG. 6A, the base member 2 may be composed of a face plate 21 and a back plate 22. The back plate 22 is arranged on the back side of the face plate 21, that is, the lower surface of the face plate 21. The upper face of the face plate 21 on which the back plate 22 is arranged is the upper surface 2*a* of the base member 2 and the lower face of the back plate 22 is the lower surface 2*b* of the base member 2.

In this example, each of the face plate 21 and the back plate 22 is a disk having substantially the same diameter in a plan view. More specifically, both the face plate 21 and the back plate 22 are donut-shaped plates having through-holes at the center in a plan view, that is, annular members. Both of the through-holes are aligned when overlapping the face plate 21 and the back plate 22 to constitute the deflation port 10.

Figure 7A:
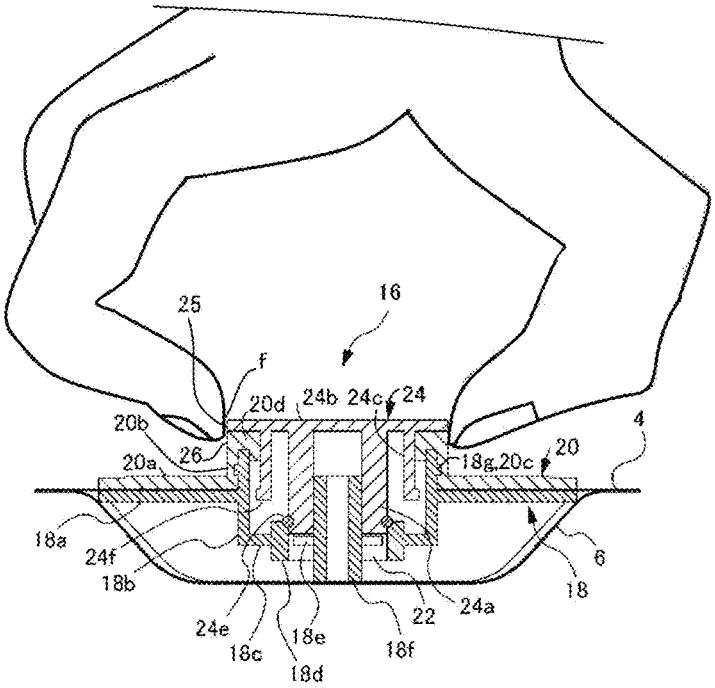
FIG. 7A (PRIOR ART)
FIG. 7A is a schematic longitudinal cross-sectional view showing a locked state of a conventional deflation valve.
Figure 7B:
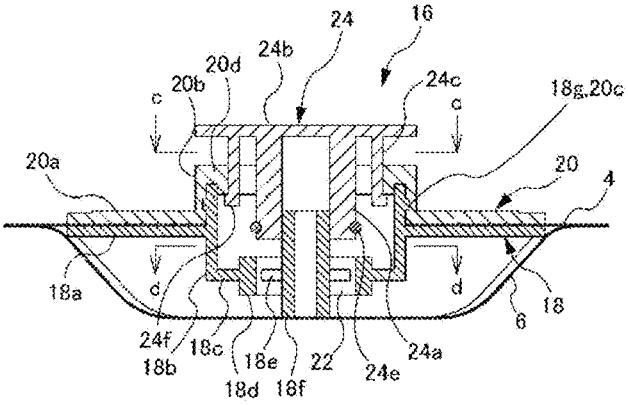
FIG. 7B (PRIOR ART)
FIG. 7B is a schematic longitudinal cross-sectional view showing an unlocked state of the deflation valve of FIG. 7A.

The base member 2 sandwiches the upper sheet B3 of the bag body B between the face plate 21 and the back plate 22. The face plate 21, the upper sheet B3, and the back plate 22 are integrated with each other with a known fixing means such as an adhesive agent. For example, as the fixing means, similarly to the engagement between the lower valve case 18 and the upper valve case 20 described in Patent Document 3 shown in FIG. 7A, it may be configured such that a convex portion corresponding to the protrusion 18*g* and a concave portion corresponding to the engaging groove 20*c* are provided so that the concave portion and the convex portion can be engaged. An adhesive agent may be used in addition to the engagement of the concave portion and the convex portion.

The base member 2 is placed on the upper sheet B3 so that the hole B5 of the upper sheet B3 is positioned between the through-hole of the face plate 21 and the through-hole of the back plate 22 to secure airflow between the inner side and the outer side of the bag body B. After the base member 2 is fixed to the upper sheet B3, the hole B5 may be formed in the upper sheet B3.

In the example shown in FIG. 6A, the inner cylindrical portion 23 is provided at the back plate 22 and exposed above the face plate 21 through the through-hole of the face plate 21. Alternatively, the inner cylindrical portion 23 may be provided on the face plate 21 (not shown).

In the embodiment shown in FIGS. 1 to 5, the fitting portion 41 of the valve member 4 is composed of a cylindrical portion and a truncated conical portion. Also, it is already discussed about changing the fitting portion 41 as a whole into a truncated cone. In the side view of the fitting portion 41, the cylindrical portion presents two parallel straight lines extending in a vertical direction, and the truncated cone portion or the circular truncated cone present two straight lines of an inverted/shape.

Besides this, in the side view of the fitting portion 41, the first closing surface 43 may be curved so that the entire outer peripheral surface of the fitting portion 41 presents a curve line. For example, the entire fitting portion 41 may be formed in a hemispherical shape or a spindle shape so that the first closing surface 43 is composed of at least a part of the surface of the sphere or the spindle shape. Further, only the portion of the fitting portion 41 below the cylindrical portion may be formed in a hemispherical or spindle-shape.

Figure 6B:
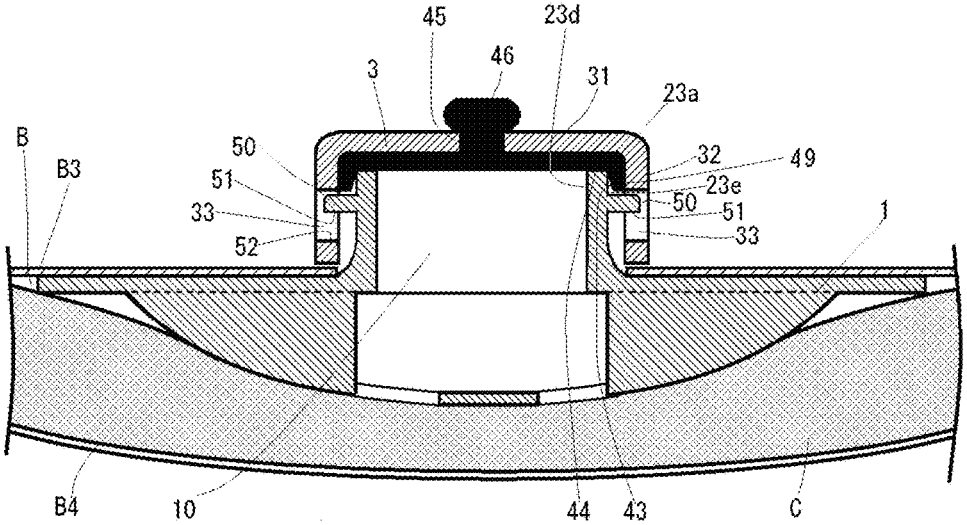
FIG. 6B is a schematic longitudinal cross-sectional view showing yet another embodiment of a deflation valve according to the present invention.

The first closing surface 43 is not limited to the convex curved surface described above, and may be formed into a concave curved surface. For example, as shown in FIG. 6B, it may be configured such that the fitting portion 41 is not provided in the valve member 4, the lower surface of the valve member 4 is formed in a flat surface, and a part of the flat surface serves as the second closing surface 44. An annular ridge portion 49 surrounding the flat surface and protruding downward may be provided in the valve member 4 and the inner peripheral surface of the ridge portion 49 may be formed in a cone shape so that the inner circumferential surface serves as the first closing surface 43. The cone shape may be formed only in the vicinity of the lower end of the ridge portion 49 on the inner peripheral surface of the ridge portion 49.

Although not illustrated, in the embodiment shown in FIGS. 1 to 6, by providing a female threaded portion on the inner peripheral surface 32*a* of the outer cylindrical portion 32 of the lid member 3 and also providing a male threaded portion on the lower large-diameter portion 23*f* of the inner cylindrical portion 23, the maintenance of the locked state can be ensured by screwing the male threaded portion into the female threaded portion at the time of shifting to the locked state after closing the valve or after shifting to the locked state. The male threaded portion is preferably provided so as to be engaged with the female threaded portion only during the transition to the locked state after the valve closing or after the transition to the locked state, so that the male threaded portion is not engaged with the female threaded portion during from the valve opening to the valve closing.

The screwing can be performed by rotating the lid member 3 with fingers hooked on the air passage portions 33.

The valve member 4 is not limited so long as the valve member is provided at the lid member 3 and can be moved up and down in accordance with the up and down movement of the lid member 3. The valve member 4 may be completely fixed to the lid member 3 so as to integrally move together with the lid member 3, or the valve member 4 may have a looseness so that the valve member 4 can move slightly up and down with respect to the lid member 3.

The matters not specifically described in each of the above modifications are the same as those in the embodiment shown in FIGS. 1 to 5.

DESCRIPTION OF REFERENCE SYMBOLS

1: deflation valve
2: base member
2*a*: upper surface (of the base member 2)
2*b*: lower surface (of the base member 2)
3: lid member
4: valve member
5: restriction mechanism
10: deflation port
21: face plate
22: back plate
23: inner cylindrical portion
23*a*: upper end face (of the inner cylindrical portion 23)
23*b*: upper end opening (of the inner cylindrical portion 23)
23*c*: edge (of the upper end opening 23*b* of the inner cylindrical portion 23)
23*d*: inner peripheral surface (of the inner cylindrical portion 23)
23*e*: outer peripheral surface (of the inner cylindrical portion 23)
23*f*: lower large-diameter portion (of the inner cylindrical portion 23)
23*g*: upper large-diameter portion (of the inner cylindrical portion 23)
24: isolation raised portion
25: protector portion
26: bridge portion
31: top plate portion (of the lid member 3)
32: outer cylindrical portion
32*a*: inner peripheral surface (of the outer cylindrical portion 32)
33: air passage portion
33*a*: upper edge (of the air passage portion 33)
33*b*: left edge (of the air passage portion 33)
33*c*: right edge (of the air passage portion 33)
33*d*: lower edge (of the air passage portion 33)
33*e*: lower end edge (of the outer cylindrical portion)
34: mounting hole
35: closing side portion
36: ridge
37: bridge portion
41: fitting portion
42: flange portion
43: first closing surface
44: second closing surface
45: fixing portion
46: head portion
47: tapered surface
48: cylindrical surface
50: restricting portion
51: restricting surface
52: restricted portion
A: compression bag
B: bag body B1: opening portion
B2: fastener
B3: upper sheet
B4: lower sheet
C: accommodation item
H: hose (of a vacuum cleaner)
H1: tip end (of the hose F)
X: height of a columnar portion (of the fitting portion 41)
Y: height of a corn portion (of the fitting portion 41)
θ: angle (of the tapered surface 47 with respect to the first closing surface 43)

The invention claimed is:

1. A deflation valve for use with a compression bag, comprising:

a base member configured to be attached to the compression bag, and a lid member configured to be attached to an upper surface of the base member, wherein:

the base member is provided with a deflation port for securing airflow between an inner side and an outer side of the compression bag, the lid member being configured to open and close the deflation port, the upper surface of the base member is configured to face the outer side of the compression bag, and a lower surface of the base member is configured to face an inner space side of the compression bag, the deflation port is a through-hole penetrating the base member from the upper surface side of the base member to the lower surface side thereof, the base member is provided on the upper surface with a cylindrical inner cylindrical portion which extends the deflation port upward from the upper surface of the base member, the lid member is a cap including a plate-shaped top plate portion and a cylindrical outer cylindrical portion, the top plate portion is provided on its lower surface with a valve member made of a material having elasticity, the material being exemplified by rubber, the outer cylindrical portion is configured to surround the valve member and extend downward from an outer edge of the top plate portion to form a side portion of the lid member, the outer cylindrical portion is provided with an air passage portion for securing airflow between an inner side and an outer side of the outer cylindrical portion, the outer cylindrical portion is arranged outwardly of the inner cylindrical portion so as to be displaced upward and downward with respect to the inner cylindrical portion, when suction of the deflation port via the lid member is performed on the upper surface of the base member, valve opening for detaching the valve member from the deflation port by upwardly displacing the lid member is performed, causing communication of the deflation port with the air passage portion by the valve opening to impart a negative pressure to the inner side of the compression bag by the suction, the lid member is automatically displaced downward by the negative pressure in the compression bag when the suction is stopped, downward displacement of the lid member causes valve closing for closing the deflation port with the valve member, causing suspension of communication between the deflation port and the air passage portion, manually displacing the lid member further downward after the valve closing to fit the valve member to the inner cylindrical portion results in locking of the lid member in the deflation port with elasticity of the valve member, the locking is released by upwardly moving the lid member gripped by hand, and the air passage portion serves as a finger hooking portion to be hooked by a finger when pulling the lid member upward, wherein the lower surface of the valve member includes a first closing surface formed into an annular shape and a second closing surface provided on a radially outer side or a radially inner side of the first closing surface, the first closing surface is a convex curved surface facing radially outward of the valve member or a concave curved surface facing radially inward of the valve member, and the second closing surface is a substantially flat surface facing downward of the valve member, in the valve closing due to a downward displacement of the lid member which received a negative pressure, the first closing surface of the valve member comes into contact with the inner cylindrical portion, and when the lid member is further pressed downward after the valve closing to forcibly fit the first closing surface on the inner side of the inner cylindrical portion or the outer side of the inner cylindrical portion, the locking is performed and the second closing surface is brought into contact with an upper end face of the inner cylindrical portion to seal the deflation port by the first closing surface and the second closing surface.

2. The deflation valve for use with a compression bag as recited in claim 1, wherein:

the outer cylindrical portion is provided with the air passage portion at at least two positions, and one of the air passage portions is positioned on an opposite side of the other of the air passage portions with respect to a circumferential direction of the inner cylindrical portion with the valve member interposed therebetween so that the lid member is capable of being pulled upward with an index finger and a thumb hooked with the air passage portions.

3. The deflation valve for use with a compression bag as recited in claim 1, further comprising:

a restricting portion formed on an outer peripheral surface of the inner cylindrical portion so as to protrude radially outward of the inner cylindrical portion; and a restricted portion formed on the outer cylindrical portion, wherein:

the restricted portion comes into contact with the restricting portion when the outer cylindrical portion is moved upward with respect to the inner cylindrical portion to prevent detachment of the lid member, and at least one of the air passage portions accommodates the restricting portion as a guide so as to allow upward and downward displacements of the restricting portion relative to the restricted portion, and a lower end of the air passage portion as the guide serves as the restricted portion.

4. The deflation valve for use with a compression bag as recited in claim 1, wherein:

the first closing surface is a convex curved surface facing radially outward of the valve member, the second closing surface is an annular surface provided on a radially outer side of the first closing surface, the valve member includes a fitting portion protruding downward on a radially inner side of the second closing surface, at least a part of the outer peripheral surface of the fitting portion serves as the first closing surface, and when the lid member is pressed after the valve closing to forcibly fit the fitting portion into the deflation port, the locking is performed and the second closing surface is brought into contact with the upper end face of the inner cylindrical portion.

5. The deflation valve for use with a compression bag as recited in claim 4, wherein the outer peripheral surface of the fitting portion is provided at a lower section of the first closing surface with a tapered surface gradually reducing in diameter of the fitting portion toward a lower end of the fitting portion.

6. The deflation valve for use with a compression bag as recited in claim 4, wherein the air passage portion serves as a window through which an upper end of the side portion of the inner cylindrical portion is visually exposed to the outer side of the outer cylindrical portion.

7. A compression bag equipped with the deflation valve as recited in claim 1.

* * * * *